United States Patent [19]

Lang

[11] 4,300,511

[45] Nov. 17, 1981

[54] MULTI-FUNCTIONAL ASSEMBLY

[75] Inventor: Jerome G. Lang, Ann Arbor, Mich.

[73] Assignee: Chrysler Corporation, Highland Park, Mich.

[21] Appl. No.: 149,811

[22] Filed: May 14, 1980

[51] Int. Cl.[3] ..... F02M 33/02; F02M 37/02

[52] U.S. Cl. ..... 123/520; 123/573; 123/90.38; 123/198 E; 123/195 C

[58] Field of Search ..... 123/518, 519, 520, 521, 123/195 C, 198 E, 572, 573, 574, 90.38

[56] References Cited

U.S. PATENT DOCUMENTS

| | | | |
|---|---|---|---|
| 2,354,722 | 8/1944 | Walton | 123/573 |
| 2,642,052 | 6/1953 | Wagner | 123/573 |
| 3,233,598 | 2/1966 | Ranst | 123/90.38 |
| 3,646,731 | 3/1972 | Hansen | 123/520 |

*Primary Examiner*—Charles J. Myhre
*Assistant Examiner*—Carl S. Miller
*Attorney, Agent, or Firm*—Newtson & Dundas

[57] ABSTRACT

A unitary structure for a vehicle engine which provides an air cleaning function, a fuel vapor storage function and a valve cover function. The structure may be molded or cast in a configuration particularly adapted to be secured to the outer portion of an engine cylinder head thus forming an enclosure means for valve components such as rocker arms and a camshaft if the engine is an overhead cam type engine. First and second wall means are spaced progressively outward from the cylinder head to form a space therebetween adapted to hold a quantity of activated charcoal. The charcoal is connected to the fuel tank and carburetor to trap and store fuel vapors therefrom. Another space is formed above the second wall means to house an air filter element. Air inlet and outlet means are located below and above the filter element to provide for a flow of air to the engine carburetor.

10 Claims, 5 Drawing Figures

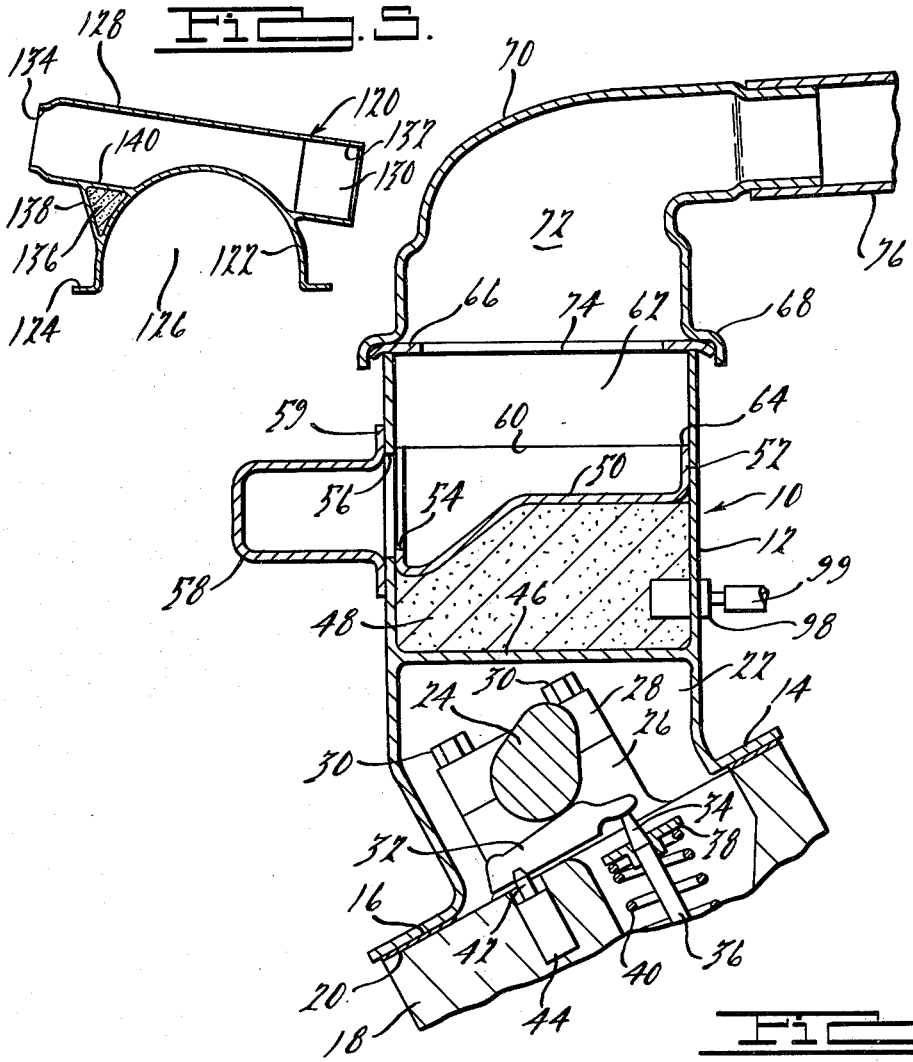
FIG. 5.
FIG. 3.
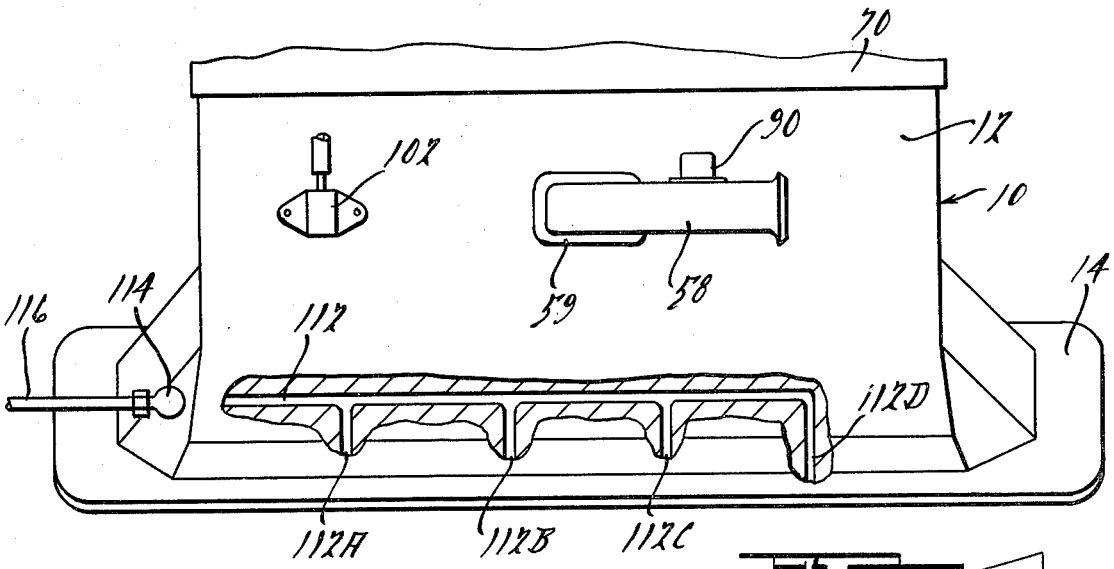
FIG. 4.

MULTI-FUNCTIONAL ASSEMBLY

FIELD OF THE INVENTION

This invention relates to a multi-functional housing assembly for a vehicle engine to provide an air cleaner function, valve component cover function and a fuel vapor trap and storage function.

PRIOR ART AND SUMMARY OF THE INVENTION

Air cleaner assemblies, valve covers and fuel vapor storage canisters have previously been used in vehicles as separate and independent components. However, the size of modern vehicles is decreasing and the hood profile is also being trimmed to provide better aerodynamics. Consequently, the size of the vehicle engine compartment is decreasing in volume and height. To provide better mileage, it is desirable to decrease the weight of components of a vehicle. The subject unitary structure is both light in weight, very compact and versatile. Because of its design and mounting arrangement vis-a-vis the engine cylinder head, one basic design may be utilized on a variety of engines within an engine family group.

The unitary structure which is the subject of this application is a molded or cast housing of light weight but strong material. A preferred material is polyester or Nylon but aluminum may also be used. A lower portion of the unitary structure is formed so as to engage the upper and outward surface of the engine cylinder about its periphery. A remotely spaced interior wall of the housing completes the enclosure of engine valve components such as overhead camshaft and rocker arms. In this way, the lubricating oil for the valve components is contained and directed back to the engine crankcase after a lubricating function is accomplished. Mineral fill may be used with the Nylon or polyester.

A second enclosure is spaced outward from the first by the placement of a second interior wall within the housing. Within the second enclosure, a vapor absorbing material such as activated charcoal is placed and appropriate inlets and conduits are provided to connect with fuel vapor emitting components such as the fuel tank and the carburetor float bowl. Another conduit connects the charcoal filled space with the fuel-air passage in the carburetor so that air may be drawn through the activated charcoal when the engine is running and therefore purge stored or trapped fuel vapors by passage into the engine.

A third enclosure is located outward from the second enclosure. An air filter element is placed therein and air inlet and air outlet means are provided on either end of the air filter so that air is cleaned as it flows to the engine. A cover assembly which can be removed from the enclosure housing attaches adjacent the outlet end of the air filter to direct air from the filter element to the carburetor inlet.

Thus it is quite obvious that the subject unitary structure provides a compact and light weight assembly to accomplish several functions. Other embodiments and modifications will readily come to mind after a reading of the following detailed description of a preferred embodiment which is shown in the accompanying drawings.

IN THE DRAWINGS

FIG. 3 is a sectional view of the unitary structure as mounted on the cylinder head of an engine and, FIG. 4 is a modified side view of a unitary structure broken away to reveal another structure to achieve an additional function as explained hereinafter; and FIG. 5 is another embodiment of the unitary structure.

Figure 1:
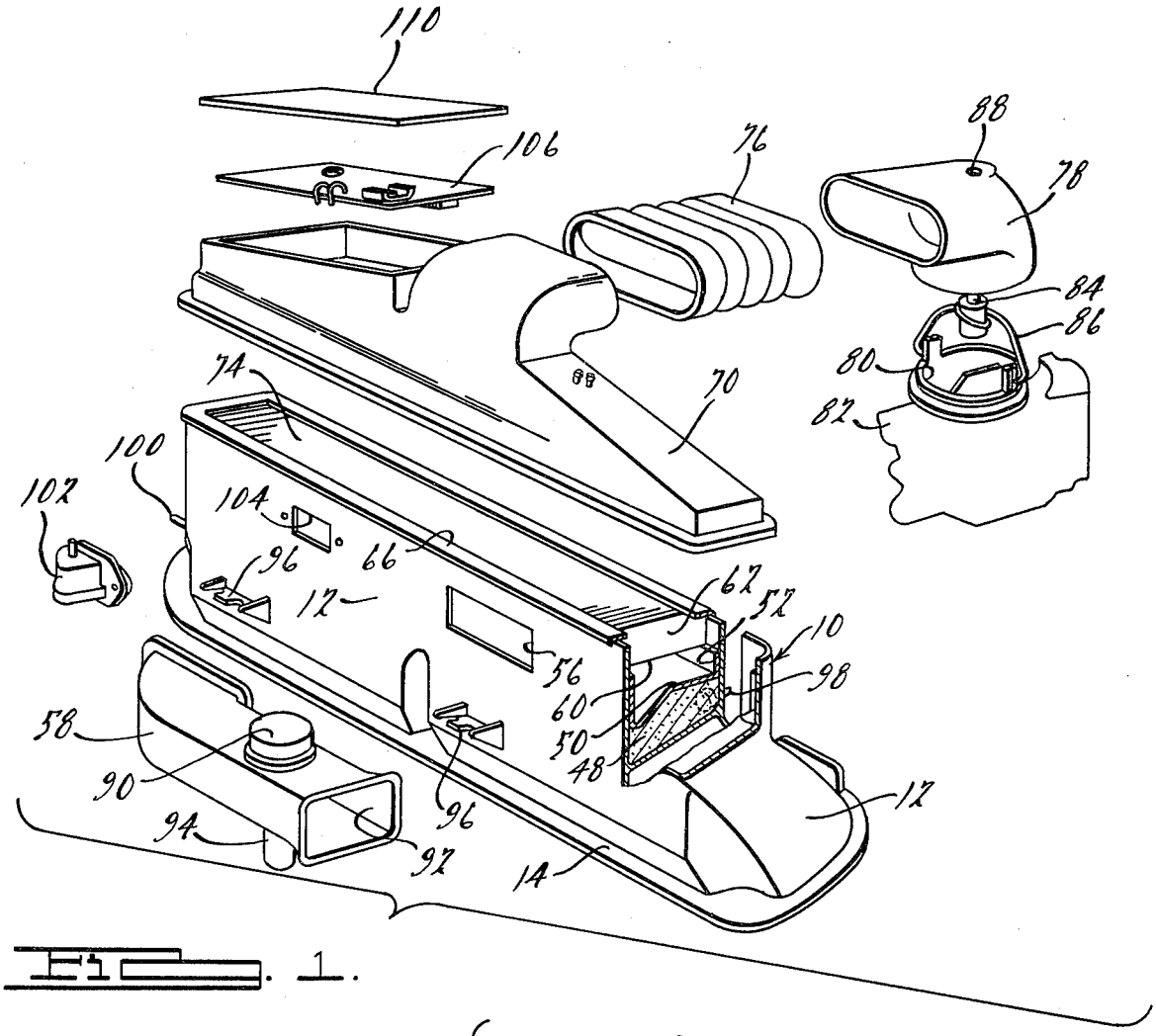
FIG. 1 is a perspective view of the unitary structure broken apart and partially sectioned so as to reveal details of its construction.

In FIG. 1 a unitary assembly 10 is illustrated with various housing portions separated one from another for clarity and with a portion of one broken away to show interior details. The assembly 10 combines the functions of an air cleaner, a valve cover and vacuum canister for storage of fuel vapors. In FIG. 3, a cross-sectional view of the assembly 10 is illustrated in attached relationship to the upper portion of the cylinder head. Referring to FIGS. 1 and 3, the unitary air cleaner and vacuum canister housing 12 is molded of glass and mineral filled Nylon material which is known for its stability and toughness. The lower surface of the housing 12 has an angled configuration best shown in FIG. 3 and includes a peripheral flanged 14 portion extending radially therefrom. The flange portion 14 is particularly adapted for attachment of the assembly 10 to the surface 16 of an engine cylinder head 18. A gasket 20 between the flange 14 and cylinder head 18 prevents oil leakage. An elongated hollow interior 22 of housing 12 covers an engine valve actuating mechanism best shown in FIG. 3. The valve actuating mechanism includes a camshaft 24 which is journaled between a cam boss 26 and a bearing cap 28. Bolt and nut fasteners 30 secure the members 26,28 together. The active lobes of the camshaft 24 engage a rocker arm member 32 the rightward end of which operably engages an upper end 34 of a valve stem 36. The valve stem 36 supports a spring retainer 38 which coacts with the upper end of a spring 40. The leftward end of the rocker arm 32 engages the upwardly projecting portion 42 of a tappet member 44 which serves as a fulcrum for the rocker arm 32 as it pivots thereabout in a general up and down motion. The downward movement of arm 32 against the valve stem 36 actuates the valve components to admit a fuel/air charge or to discharge exhaust gases with respect to the combustion chamber.

The valve cover space 22 is defined at an upper surface by interior wall 46 of the housing 12. Another cavity or space 48 is formed above space 22 between the bottom wall 46 and an upper wall 50. Space 48 is filled with a vapor absorbing material such as activated charcoal and is adapted to be connected to the engine's carburetor and fuel system so that fuel vapors from the carburetor float bowl and the fuel tank are absorbed rather than being discharged to the atmosphere. The upper wall 50 has a rim portion 52 which frictionally engages the inner surfaces of the housing 12. A cut-out or removed portion 54 at one location in the rim portion 52 is complementary to an opening 56 in the wall of the housing 12 and thus forms an air inlet. An air inlet snorkel assembly 58 is adapted to be attached to the housing 12 for receiving heated or unheated air as determined by the position of an air control valve assembly which will be discussed hereinafter.

The wall 50 acts as an air directing surface means to the bottom portion 60 of an air cleaner element 62 which may be of the pleated paper type currently popular. The peripheral edges of element 62 rest against the upper end surface 64 of the wall 60. Element 62 is sealingly retained within housing 12 by a gasket member 66 which is engaged by the outwardly projecting edge 68 of a removable air cleaner cover assembly 70. The interior 72 of the air cleaner cover assembly 70 receives the filtered air from the outlet portion 74 of air cleaner 62 and directs the air upward and to the right in FIG. 3 to a flexible link connector 76. The connector 76 is attached both to the cover 70 and to a carburetor elbow member 78 to guide the air downward into the intake 80 of a carburetor assembly 82. A threaded receiver 84 is attached to the carburetor by a wire linkage 86 and is adapted to threadably engage a fastener which is adapted to project through the opening 88 in the carburetor elbow.

When the engine is in a warm-up mode, it is desirable to warm the air prior to admission to the assembly 10. To this end, a vacuum motor 90 is visible in FIG. 1 which is connected through the upper wall of member 58 to a damper door (not visible). The damper door moves between positions permitting cold air to enter through opening 92 or warmed air to enter through the lower tube 94. The air entering tube 94 is heated in a conventional manner by passage about the engine exhaust manifold. In this way, air of proper temperature is introduced to the engine. Also of note in FIG. 1 are outwardly projecting members or tabs 96 on member 12 which have notches formed therein. The function of the tabs 96 is to hold the spark plug wires of the engine in proper orientation.

Heretofore, the engine air supply has been described. Another important function of the unitary structure 10 is the provision for a fuel vapor trap utilizing activated charcoal in the space 48. Space 48 communicates by means of a purge valve and hose fitting 98 with the carburetor 82 shown in FIG. 1. An inlet fitting 100 located at the opposite end of the structure 10 is adapted to be connected by hose or conduit to an upper region of a vehicle fuel tank so that vapors move therefrom to the activated charcoal for storage. When the engine is started, the stored vapors within the activated charcoal are removed or purged to the carburetor through the fitting 98. Also, another fitting and inlet to the space 48 is provided so that fuel vapors from the carburetor float bowl are stored communicated with the charcoal.

Figure 2:
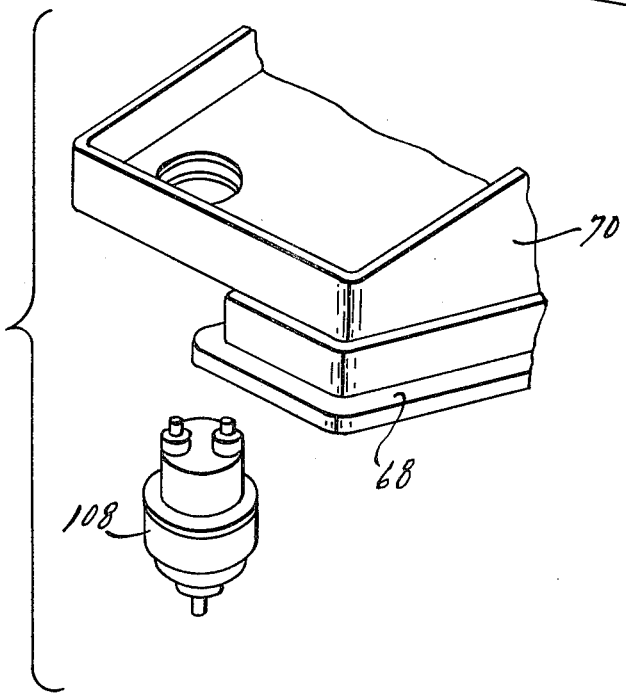
FIG. 2 is an enlarged fragmentary view of the rear portion of the structure shown in FIG. 1.

In addition to its primary functions described heretofore, the unitary assembly 10 serves to house and mount various engine related components. In FIG. 1, an OSAC valve 102 (vacuum bleed valve) monitors the application of vacuum to the distributor advance mechanism. The valve 102 is adapted to be attached to the sidewall of the housing 12 and project partly through opening 104 therein. This vacuum valve has been used on Chrysler Corporation engines for a number of years and aids in emission control. Bleed air for the vacuum valve 102 is drawn from the interior of housing 12. Another engine accessory which is readily mounted on the assembly 10 is the ESA circuit board 106 shown in FIG. 1 and ESA vacuum transducer assembly 108 shown in FIG. 2 which is a view of the backside of assembly 10 in FIG. 1. A cover 110 protects the circuit board 106 from contamination.

In FIG. 4, another slightly modified embodiment of the assembly 10 is illustrated with like portions labeled as in FIGS. 1 and 3. However, a new function has been added to this embodiment. An internal passage 112 has been formed therein and branch passage 112 a,b,c and d are in fluid communication with internal passage 12. Passage 112 is connected through a fitting 114 to a fuel supply line 116. The fuel supply line 116 and passages 112 are utilized in a fuel injection system for the engine.

In FIG. 5, another embodiment of the unitary structure is illustrated which would be particularly suitable for use on a small engine such as a four cylinder in-line type engine. On V-type engines, the configuration shown in FIGS. 1–3 would be suitable since the cylinder banks are inclined as to a vertical. However, on small in-line engines, the cylinder bank extends generally vertically and it is desirable to conserve space particularly in the vertical dimension. The embodiment of FIG. 5 in a low profile unitary structure having the same functional characteristics as the other embodiment.

The unitary structure 120 has a valve cover portion 122 of generally semi-circular configuration. Edge flanges 124 are adapted to engage the cylinder head in the same manner as shown in FIG. 3. A space 126 is thus provided for the projecting portions of the valve components as also seen in FIG. 3. Atop the portion 122 is formed an air intake and air cleaner portion 128 which is slightly inclined with respect to the horizontal but could be absolutely horizontal if so desired. The rightward end of the portion 128 supports an air cleaner element 130 in passage 132. The element 130 is preferably of the paper type which is commonly used. The leftward end of portion 128 is reduced at 134 to accept a flexible hose (not shown) which is for passing air to a carburetor or similar device. A quantity of activated charcoal material 136 is used for the function described previously in this application and is enclosed by portions 122,128 and wall means 138 as shown in FIG. 5. Fitting to communicate material 136 with the carburetor fuel bowl, the fuel tank and any other source of potential emissions are not shown. They obviously must be provided. If a communication between material 136 and a clean air supply is desired such as for purging the charcoal, an opening may be formed in the wall portion 128 at the approximate location 140.

Although only a few basic embodiments of the unitary structure have been illustrated and desired material specifications have been suggested, modifications may be made and still be well within the scope of the invention as defined by the following claims:

I claim:

1. A unitary and multifunctional structure for a vehicle engine including a cylinder head and valve components thereon, comprising; a hollow multi-cell housing formed of light weight but strong material and having a peripheral edge portion adapted to engage the cylinder head about the valve components thereby preventing the leakage of lubricating oil between the unitary structure and the cylinder head; first interior wall means spaced outward from the cylinder head and valve components thereon forming a substantially sealed enclosure thereabout; second interior wall means spaced outwardly from the first wall means thereby forming an interior space therebetween which is filled with a fuel vapor absorbing material such as charcoal; an air filter element supported so that one end portion is located above the second wall means to form an air inlet plenum therebetween; means for ducting atmospheric air to the air inlet plenum; cover means about the opposite end portion of the air filter element forming an air outlet plenum to direct cleaned air from the filter element toward an engine air inlet.

2. A unitary structure combining the functions of valve cover, fuel vapor storage container and air admission housing for a vehicle engine of the type including a cylinder head and valve components supported thereon, comprising; thin-walled enclosure means having a first open end adapted to receive the valve components and having peripheral edge means thereabout adapted to seal against the cylinder head to prevent the escape of lubricating oil therebetween; the enclosure means having first and second interior walls progressively spaced outward from the peripheral edge means thus forming a space therebetween which is substantially filled with a fuel vapor storing material such as charcoal; a removable cover member engaging an opposite second end of the enclosure means to form an air flow plenum for the engine defined between the cover member and the second interior wall; means for admitting air to the plenum and for directing air therefrom.

3. The unitary structure set forth in claims 1 or 2 in which the first wall means is integrally formed with the housing and the second wall means is a separate member to be interference fit or similarly attached to the housing subsequent to filling the interior space with fuel vapor absorbing material.

4. The unitary structure set forth in claims 1 or 2 in which the air inlet ducting means includes an elongated hollow member having a first inlet open to air at ambient temperature, a second inlet open to heated air and thermostatically controlled valve means for controlling air flow therethrough to produce a desired air inlet temperature.

5. The unitary structure set forth in claim 1 in which the second wall means is a separate member to be frictionally fitted or similarly attached to the housing means and with an upwardly turned edge portion which forms a seat for engagement with the peripheral edge of the air filter elements one end.

6. An improved multifunctional air inlet, fuel vapor storage and valve cover means for a vehicle engine of the type having a cylinder head, valve components thereon and a carburetor, the improvement comprising; a thin-walled enclosure means including a first open end portion with flange means thereabout for receiving the valve components and for sealingly engaging a peripheral portion of the cylinder head thereabout; the enclosure means having a series of interior partitions progressively spaced from the open end portion to define a fuel vapor containment space which is filled with a vapor storing material, such as charcoal and to define an air plenum cooperative with an opposite end cover of the enclosure means to form a flow path for atmospheric air to the carburetor; air inlet means to the plenum.

7. The improved multifunctional enclosure means as set forth in claim 6 in which the enclosure means has an integrally formed first wall means and a separate second wall means, the second wall means supported by engaging the interior walls of the enclosure means in frictional relation subsequent to filling the space above the first wall means with fuel vapor storing material.

8. The improved multifunctional enclosure means as set forth in claim 7 in which the second wall means has a peripheral edge portion which is turned normally with respect to its midportion thus presenting a peripheral edge which acts as a seat for the air filter element.

9. A unitary and multifunctional structure for a vehicle engine including a cylinder head with valve components thereon comprising: a generally hollow and multicompartmentalized housing formed of light weight but strong material; an open-sided valve cover portion of the unitary structure having a peripheral edge portion about the one side for engagement with the engine cylinder head, thereby enclosing the valve components and preventing leakage of lubricating oil therefrom; an elongated hollow air directing portion of the unitary structure for receiving engine air through an inlet at one place for discharging air through an outlet at an opposite place and for filtering air therebetween; a vapor storage portion of the unitary structure thus defining an enclosure which holds a vapor storing material; the valve cover, air directing and vapor storage portions being defined by a common unitary and thin walled housing structure and including partition walls extending therebetween to separate pairs of said portions one from another.

10. A unitary and multifunctional structure for a vehicle engine including a cylinder head with valve components hereon comprising: a generally hollow and multicompartmentalized housing formed of light weight but strong material; an open-sided valve cover portion of the unitary structure having a peripheral edge portion about the one side for engagement with the engine cylinder head, thereby enclosing the valve components and preventing leakage of lubricating oil therefrom; an elongated hollow air directing portion of the unitary structure for receiving engine air through an inlet at one end, for discharging air through an outlet at an opposite end for supporting filter means which cleans the engine air; the valve cover portion and air directing portion sharing a common wall with the opposite end portions of the latter directed laterally outward from the elongated extent of the former; a vapor storage portion of the unitary structure including a wall extending between wall portions of the valve cover and air directing portions thus defining an enclosed space containing a vapor storing material.

* * * * *